US005275530A

United States Patent [19]

Kujawa et al.

[11] Patent Number: 5,275,530

[45] Date of Patent: Jan. 4, 1994

[54] CONDENSATE SEAL FOR INDUCED DRAFT MOTOR

[75] Inventors: Matthew Kujawa, Danville; Timothy J. Waterman, Carmel, both of Ind.

[73] Assignee: Carrier Corporation, Syracuse, N.Y.

[21] Appl. No.: 739,007

[22] Filed: Aug. 1, 1991

[51] Int. Cl.[5] ..... F04D 29/12

[52] U.S. Cl. ..... 415/170.1; 415/174.2; 415/230; 277/136; 277/152; 277/178; 277/207 R

[58] Field of Search ..... 415/170.1, 174.2, 229, 415/230; 277/136, 137, 152, 178, 207

[56] References Cited

U.S. PATENT DOCUMENTS

| | | | |
|---|---|---|---|
| 2,983,529 | 5/1961 | Price | 277/178 X |
| 3,776,559 | 12/1973 | Cawthorn | 277/178 X |
| 4,474,379 | 10/1984 | Holzer | 277/178 X |
| 4,494,759 | 1/1985 | Kieffer | 277/178 X |
| 5,025,930 | 6/1991 | Barthelmess | 415/171.1 X |

FOREIGN PATENT DOCUMENTS

| | | | |
|---|---|---|---|
| 1032629 | 6/1958 | Fed. Rep. of Germany | 277/178 |
| 1801320 | 10/1968 | Fed. Rep. of Germany | 277/178 |
| 441224 | 1/1936 | United Kingdom | 277/137 |
| 780114 | 7/1957 | United Kingdom | 277/178 |

*Primary Examiner*—John T. Kwon

[57] ABSTRACT

A floating seal arrangement is provided between the drive shaft of an electric motor and the cover plate of an inducer housing, through which the shaft extends. This allows radial movement of the shaft within the housing opening, while at the same time preventing the migration of a liquid from the inducer housing to the motor.

13 Claims, 3 Drawing Sheets

CONDENSATE SEAL FOR INDUCED DRAFT MOTOR

BACKGROUND OF THE INVENTION

This invention relates generally to seal structures and, more particularly, to a condensate seal around the shaft of a draft inducer motor for a condensing furnace.

An induced draft furnace is one in which the combustion process is supported not only by the natural convection of air through the unit but also by a motor driven, or induced draft, blower to accelerate the flow of air to the combustion chamber. The induced draft blower can be either a blow-through or a draw-through type, but is most commonly used downstream of the heat exchanger(s) to draw the combustion gases from the heat exchanger(s) and out the flue. The induced draft blower is particularly needed where there is a significant pressure drop across the heat exchanger(s), such as in the case of a condensing furnace wherein, in addition to the primary heat exchanger, there is a condensing heat exchanger which extracts from the combustion gases not only additional sensible heat but also the latent heat which causes a phase change from the gaseous to a liquid state. The resulting condensate is normally drained from the condensing heat exchanger by an appropriate drainage tube. However, there is a certain amount of condensate that is drawn up into the inducer blower wheel as the combustion gases are discharged into the flue. This condensate then tends to migrate from the blower wheel, along the motor shaft, into the inducer motor where it can enter the bearings and cause damage thereto because of the relatively high acid content in the condensate.

One method of preventing the migration of condensate along the motor shaft is to provide a seal around the motor shaft where it penetrates the wall of the inducer housing. However, this approach may be in conflict with the need to provide relative movement of the inducer motor with respect to the inducer housing. That is, in order to reduce the motor vibration during operation of the system, the motor may be mounted on elastomeric grommets that relax and settle over time. Thus, both the motor and the shaft will move within the penetration opening of the inducer housing. A normal seal device will therefore not satisfactorily perform in this environment.

It is therefore an object of the present invention to provide an improved seal device for the shaft of an inducer motor.

Another object of the present invention is the provision in an induced draft blower for preventing the migration of condensate to the electric motor.

Yet another object of the present invention is the provision in an induced draft blower for reducing inducer motor vibration.

Still another object of the present invention is the provision in an induced draft blower for a condensate seal that is economical to manufacture and effective in use.

These objects and other features and advantages become more readily apparent upon reference to the following description when taken in conjunction with the appended drawings.

SUMMARY OF THE INVENTION

Briefly, in accordance with the one aspect of the invention, an elastomeric seal is shaped and sized in such a manner as to allow it to radially float within the opening of the inducer housing, while continually surrounding the motor shaft which penetrates the housing.

In accordance with another aspect of the invention, the seal comprises an annular disc which is placed on a motor side of the inducer housing and which overlaps and engages the edges of the opening in the housing to thereby provide a sealing relationship therewith. Integrally connected at its inner diameter is a collar which projects through the housing opening and whose outer diameter is substantially less than that of the housing opening to allow relative radial movement therebetween, while the inner diameter of the collar maintains frictional contact with the motor shaft.

By yet another aspect of the invention, a second annular disc is attached to the other end of the collar, with the second annular disc then engaging the inducer wheel side of the motor housing. The inducer housing is then captured between the axially spaced annular discs to provide a sealing relationship therebetween. Provision is also made to prevent rotation of the seal with respect to the inducer housing.

In accordance with another aspect of the invention, the inducer housing has an annular flange extending axially toward the inducer blower wheel to thereby retard and divert the condensate flow from its radially inward movement toward the seal element.

In the drawings hereinafter described, a preferred embodiment is depicted; however, various other modifications and alternate constructions can be made thereto without departing from the true spirit and scope of the invention.

DESCRIPTION OF THE PREFERRED EMBODIMENT

Figure 1:
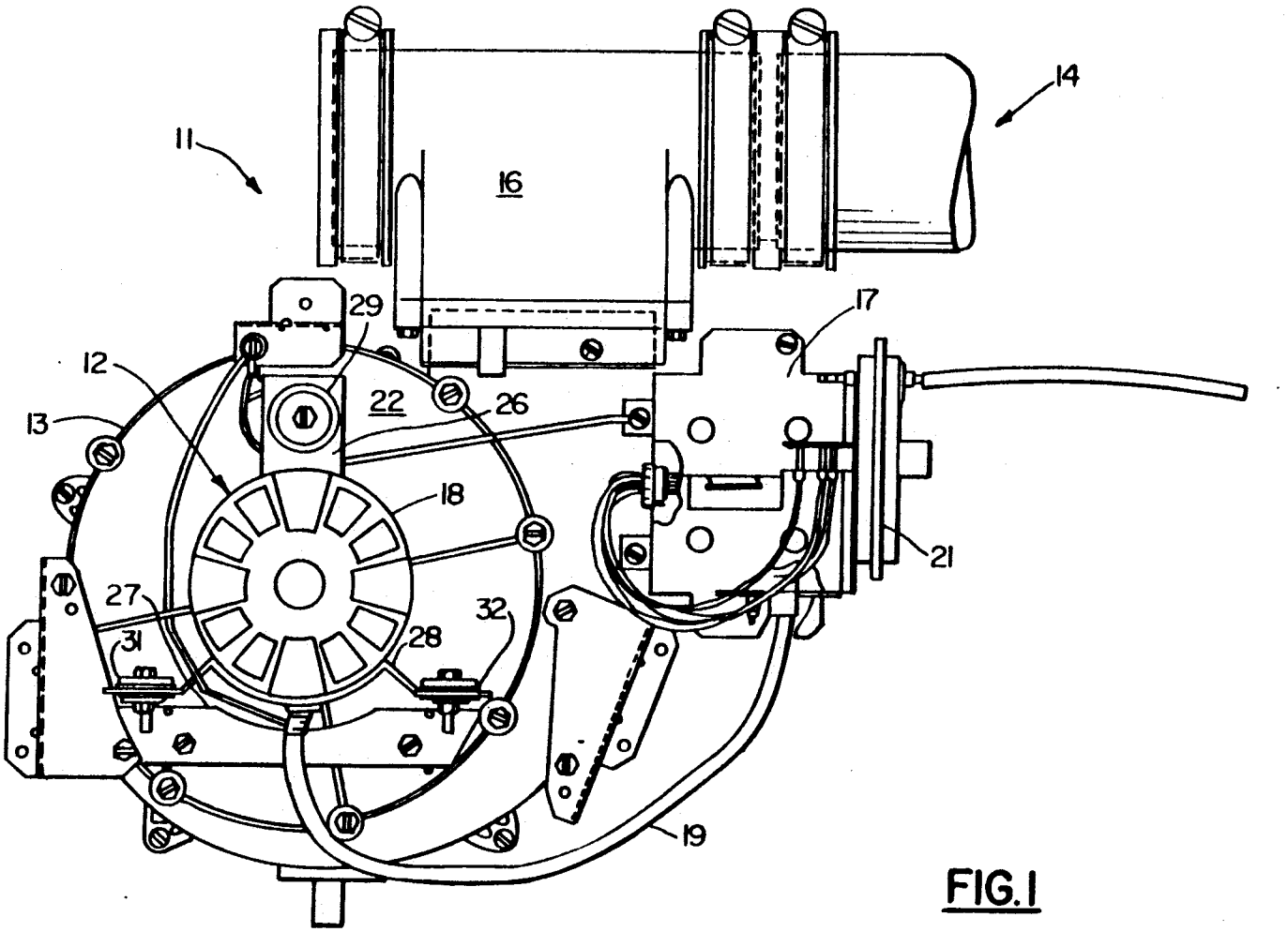
FIG. 1 is a front view of motor driven inducer having the present invention incorporated therein.

Referring now to FIG. 1, there is shown a draft inducer assembly 11, having the present invention, generally indicated at 12, incorporated therein. The assembly 11 includes an induction blower 13 which draws combustion air from a heat exchanger (not shown) and discharges it to a furnace exhaust vent 14 by way of an outlet box 16. An inducer control box 17 selectively provides power to an electric drive motor 18 by way of a lead 19 to thereby control the operation of the induction blower 13. A pressure switch 21 functions to sense certain pressure conditions within the system and provide inputs to the inducer control box 17 relative thereto.

Figure 2:
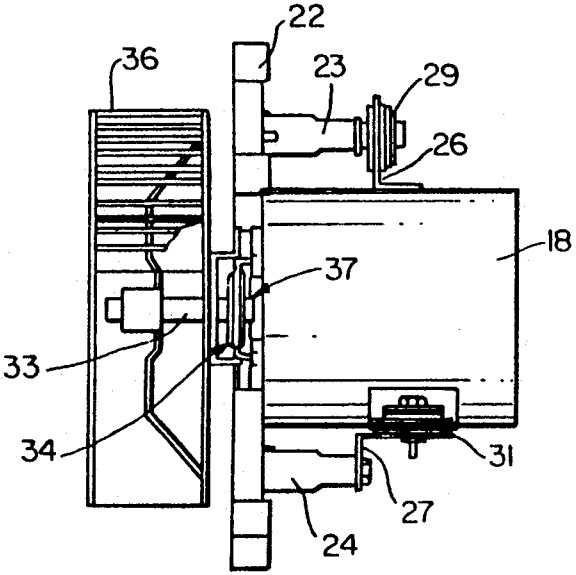
FIG. 2 is a side view thereof with a portion broken away.
Figure 5:
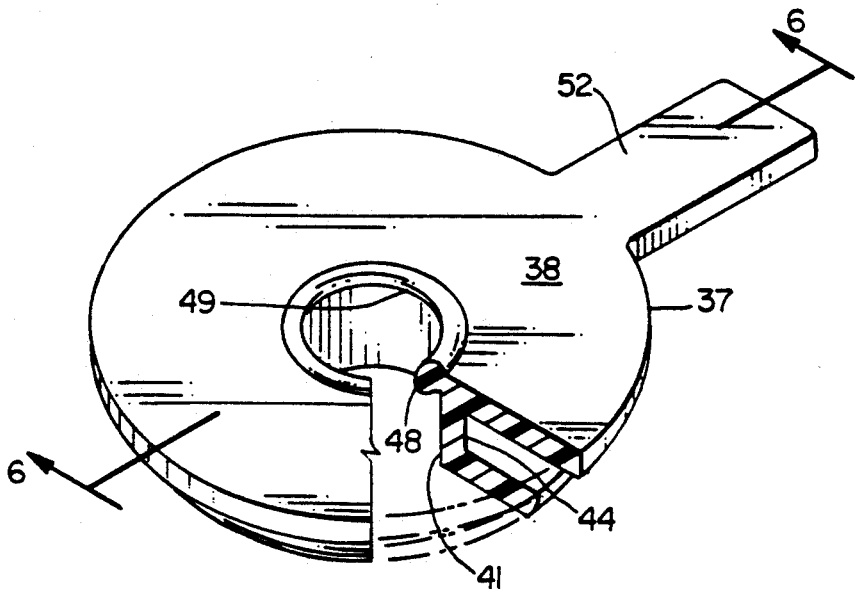
FIG. 5 is a perspective view of a seal portion thereof.
Figure 6:
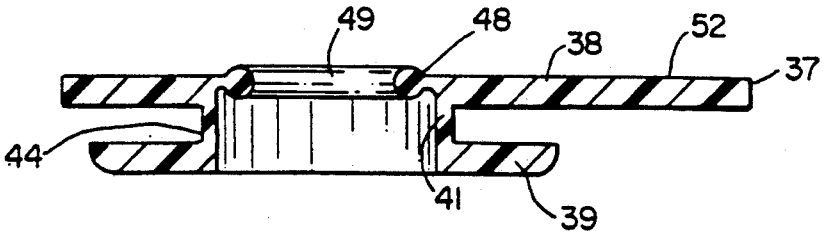
FIG. 6 is a sectional view as seen along lines 6—6 of FIG. 5.

The induction blower 13 includes at one end thereof, a cover plate 22 with three integral posts extending axially outwardly therefrom, two of the posts being shown at 23 and 24 in FIG. 2. The motor 18, in turn, has mounting brackets 26, 27 and 28 secured to the posts by way of elastomeric grommets 29, 31 and 32, respectively. This flexible mounting arrangement allows the motor 18 to undergo vibration movement without transmitting the same to the inducer 13 where it would tend to cause noise. It will be thus understood that the motor 18 will undergo movement with respect to the cover plate 22.

Figure 3:
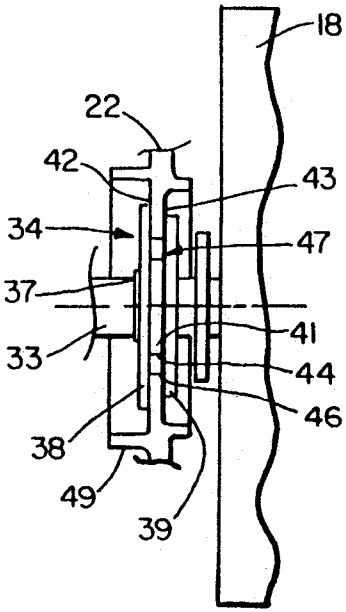
FIG. 3 is an expanded view of the inducer housing wall with an incorporated seal portion of the present invention.

Referring now to FIGS. 2 and 3, it will be seen that the drive shaft 33 of the motor 18 passes through the cover plate 22 by way of an opening 34 to drivingly connect to a blower wheel 36 within the housing of the induction blower 13. Inasmuch as it is necessary for the motor 18 to move relative to the cover plate 22, the motor drive shaft 13 will also move radially within the opening 34 of the cover plate 22. The present invention is designed to allow this movement while, at the same time, preventing the migration of vapor from within the blower housing to pass through the opening 34 and enter the motor 18 where it could cause damage to the bearings.

Referring to FIGS. 3-6, the condensate seal 37 is comprised of annular disc portions 38 and 39 interconnected by a collar portion 41. The annular disc portion 38 engages the inner side 42 of the cover plate 22 and the annular disc portion 39 engages the outer side 43 thereof. As will be seen, the outer diameter 44 of the collar 41 is substantially smaller than the inner diameter 46 of the cover plate opening 34. An annular space 47 is therefore provided to allow for the shaft 33 to move radially within the opening 34, with the annular disc portions 38 and 39 engaging and sliding over the respective surfaces of the inner and outer sides, 42 and 43, respectively to provide a sealing relationship therewith.

The collar 41 of the seal 37 includes an integral ring portion 48 (see FIGS. 5 and 6) which extends radially inwardly to the extent of an inner diameter 49 which is just slightly larger than the diameter of the motor shaft 33 such that the elastomeric ring 48 will fit over the shaft 33 in a sealing manner but allow the shaft 33 to rotate therein, while at the same time preventing migration of fluids along the shaft 33.

It should be mentioned that, in the vicinity of the inner wall 42 of the cover plate 22, a negative pressure exists because of the operation of the inducer wheel 36. Thus, the higher pressure from the outer side 43 of the cover plate 22 tends to cause the annular disc portion 39 to engage the outer wall 43 of the cover plate 22. For this reason, it would be possible to eliminate the annular disc portion 38 and rely only on annular disc portion 39 to provide the sealing engagement with the cover plate outer wall 43. In such cases, however, it would still be necessary to provide some means to prevent rotation of the seal 37 with the shaft 33.

Figure 4:
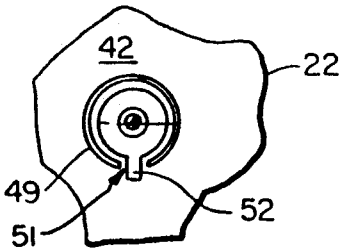
FIG. 4 is a front view of the seal portion thereof.

Referring now to FIGS. 3-4, it will be seen that the cover plate 22 includes an annular rim 49 which extends axially outwardly from the inner side 42 of the cover plate 22, in surrounding relationship with the annular disc portion 38. This rim functions to somewhat isolate the condensate seal 37 from the radially inward swirl of condensate that might otherwise come in contact with the seal. That is, the rim 49 tends to divert that flow and cause the liquid to drop to the bottom of the unit.

It will be seen in FIG. 4 that the annular rim 49 includes a discontinuous portion or opening 51 at its lower side. This opening acts as a water drain slot where condensate can drain out of the rim 49 if any condensate does enter this area. It also acts to locate a shaft seal tab 52 extending radially outwardly from the annular disc portion 38 of the seal 37 to prevent the seal 37 from rotating along with the shaft 33.

In addition to providing a floating shaft arrangement which allows for vibration of the motor with respect to the cover plate 22, the condensate seal 37 also allows for ageing of the grommets 29, 31 and 32. That is, as the assembly is built, the condensate seal 37 will be at approximately at the highest point that it can be in the opening 34 of the cover plate 22. When the grommets relax with age, they will gradually move toward a "bottoming out" position against the mounting brackets. The relative sizing is therefore preferably selected such that, at the point of "bottoming out" the condensate seal will also be bottomed out in the inducer cover plate opening 34.

While the invention has been described with some specificity as shown in the preferred embodiment, it will be recognized by those skilled in the art that various modifications and alternate constructions can be made thereto while remaining within scope and spirit of the present invention.

What is claimed:

1. An elastomeric seal for preventing the migration of condensate from within a draft inducer housing to an electrical drive motor by way of the motor shaft extending through an opening in the housing wall, comprising;

a first annular disc portion having an inner diameter smaller than the diameter of the housing wall opening and an outer diameter greater than the diameter of the housing wall opening, said annular disc being positionable against a motor side of the housing wall opening; and a collar integrally connected to said first annular disc proximate its inner diameter and extending through the housing wall opening, said collar portion having an inner diameter closely surrounding the motor shaft to prevent the migration of condensate therealong, and having an outer diameter substantially smaller than the diameter of the housing wall opening, such that an annular space is provided between the collar and the housing wall to permit relative radial movement of the collar within the housing wall opening.

2. An elastomeric seal as set forth in claim 1 wherein said the collar includes a cylindrical portion and an annular flange portion extending radially inwardly to frictionally engage the motor shaft.

3. An elastomeric seal as set forth in claim 2 wherein said radially inwardly extending annular flange portion is aligned substantially normally to the axis of the shaft.

4. An elastomeric seal as set forth in claim 3 and further wherein said annular flange portion has a ring at its radially inner edge, with said ring being substantially round in cross section.

5. An elastomeric seal as set forth in claim 1 and including a second annular disc axially spaced from said first annular disc and having an inner diameter smaller than the diameter of the housing wall opening and an outer diameter greater than the diameter of the housing wall opening, said second annular disc being positionable against a blower wheel side of the housing wall opening.

6. An elastomeric seal as set forth in claim 1 and including means for preventing the relative rotation of the seal with respect to the housing wall.

7. An elastomeric seal as set forth in claim 6 wherein said rotation prevention means comprises a tab extending radially outwardly from said seal to engage an axial extension on the housing wall.

8. In an induced combustion furnace of the type having an inducer wheel rotatably mounted within a housing and being drivingly connected to an electric motor by way a shaft extending through an opening in a cover plate of the housing, an improved seal element comprising;

a pair of axially spaced elastomeric, annular discs interconnected near their inner diameters by an elastomeric collar;

the outer diameter of said elastomeric collar being substantially smaller than the diameter of the cover plate opening to define an annular space between said collar and the edge of said cover plate which defines said cover plate opening, and the internal diameter of said elastomeric collar being slightly larger than the outer diameter of the motor shaft;

such that the seal element may be installed between the motor shaft and the cover plate, with each of said annular discs being disposed on and engaging a side of said cover plate, and with said elastomeric collar being able to float radially within the cover plate opening, while said elastomeric cylinder inner diameter sealingly engages a motor shaft to prevent the migration of condensate therealong.

9. An improved seal element as set forth in claim 8 wherein said collar includes a cylindrical portion and an annular flange portion extending radially inwardly to frictionally engage the motor shaft.

10. An improved seal element as set forth in claim 9, wherein said annular flange portion extends substantially normally to the axis of the shaft, and includes a ring at its radially inner edge, with the ring having a substantially circular cross section.

11. An improved seal element as set forth in claim 8 and including means for preventing the seal from rotating within the cover plate opening.

12. An improved seal element as set forth in claim 11 wherein said rotation prevention means comprises a radially extending tab on one of said elastomeric annular discs, said tab being positionable against an axial extension from the cover plate.

13. An improved seal element as set forth in claim 8 and including a diverter means extending axially from the inducer blower wheel side of the cover plate to divert the radially inward flow of condensate from said seal element.

* * * * *